US005575207A

United States Patent [19]

Shimizu

[11] Patent Number: 5,575,207

[45] Date of Patent: Nov. 19, 1996

[54] SUCTION APPARATUS FOR PRINTING PRESS

[75] Inventor: You Shimizu, Ibaragi, Japan

[73] Assignee: Komori Corporation, Japan

[21] Appl. No.: 549,536

[22] Filed: Oct. 27, 1995

[30] Foreign Application Priority Data

Nov. 2, 1994 [JP] Japan ..... 6-269601

[51] Int. Cl.[6] ..... B41F 13/24

[52] U.S. Cl. ..... 101/232; 271/183

[58] Field of Search ..... 101/232, 231, 101/420, 177, 183, 216, 217; 271/99, 100, 183, 197

[56] References Cited

U.S. PATENT DOCUMENTS

| | | | |
|---|---|---|---|
| 4,776,577 | 10/1988 | Marschke et al. | 271/183 |
| 4,997,178 | 3/1991 | Ogoda | 271/197 |
| 5,139,253 | 8/1992 | Bohme et al. | 271/197 |
| 5,165,679 | 11/1992 | Kinomoto | 271/197 |
| 5,417,158 | 5/1995 | Parsio | 101/232 |
| 5,423,255 | 6/1995 | Maass | 101/232 |
| 5,497,987 | 3/1996 | Henn et al. | 101/232 |

FOREIGN PATENT DOCUMENTS 1-36609 11/1989 Japan .

*Primary Examiner*—Ren Yan

*Attorney, Agent, or Firm*—Blakely Sokoloff Taylor & Zafman

[57] ABSTRACT

A suction apparatus for a printing press includes a plurality of suction ports and air shutter devices. The suction ports suck and hold an object used for a printing operation. The air shutter devices are provided to the suction ports on at least one end portion side not used for a suction operation of a small-size object. Each of the air shutter devices is constituted by a passage block having an air passage through which air for sucking an object passes, a magnetic member arranged around an air passage opening portion of the passage block, and a shutter member consisting of a magnetic material and movable between a closed position where the air passage opening portion of the passage block including the magnetic member is closed and an open position where the air passage is open, one of the magnetic member and the shutter member being magnetized. The shutter member moves to the closed position to close the air passage opening portion of the passage block by an air suction force and a magnetic attraction force between the shutter member and the magnetic member when the suction operation of the small-size object is performed.

10 Claims, 6 Drawing Sheets

SUCTION APPARATUS FOR PRINTING PRESS

BACKGROUND OF THE INVENTION

The present invention relates to a suction apparatus for a printing press, which temporarily sucks and holds an object used for a printing operation and, more particularly, to a suction apparatus for a printing press, which sucks the trailing edge of a paper sheet through a suction port to the circumferential surface of a paper convey cylinder such as a reversing cylinder, an impression cylinder, or a transfer cylinder, thereby stably conveying the paper sheet.

In a conventional sheet reversing device for a double side printing operation in a sheet-fed printing press, which is disclosed in Japanese Utility Model Publication No. 1-36609, a plurality of suction heads for sucking and holding a paper sheet through an air suction force are provided to a reversing cylinder while being arranged in the axial direction in correspondence with the maximum paper size. With this arrangement, the trailing edge of a paper sheet wound on the surface of an impression cylinder is sucked by the suction heads of the reversing cylinder to separate the paper sheet from the surface of the impression cylinder. The suction heads sucking the trailing edge of the paper sheet move to the reversing grippers of the reversing cylinder and transfer the paper sheet. Thereafter, the suction operation of the suction heads is stopped to retreat the suction heads to a predetermined position, and the paper sheet is reversed.

In the above conventional suction apparatus, however, when a small-size paper sheet is used, external air is sucked through the suction heads at the two end portions not used for the suction operation. This results in a large decrease in suction force, so no small-size paper sheet can be sucked.

To solve this problem, shutter plates can be provided to the air passage holes of the suction heads at the two end portions. When a small-size paper sheet is to be sucked, the air passage holes are closed by the shutter plates to stop air suction through the suction heads at the two end portions. However, in an arrangement for only mechanically closing the air passage by the shutter plate, the air passage may be insufficiently closed, resulting in air leakage from a small gap between the shutter plate and the air passage hole. In case of such air leakage, the degree of vacuum in the suction heads at the central portion used for the paper suction operation is degraded to weaken the paper suction force. Therefore, a printing registration error is caused by a paper offset at the suction heads, or the paper sheet falls due to a suction error.

SUMMARY OF THE INVENTION

It is an object of the present invention to provide a suction apparatus for a printing press, which can suck a small-size object used for a printing operation.

It is another object of the present invention to provide a suction apparatus for a printing press, which prevents air leakage to perform a proper suction operation.

In order to achieve the above objects, according to the present invention, there is provided a suction apparatus for a printing press, comprising a plurality of suction ports, for sucking and holding an object used for a printing operation, and air shutter devices provided to the suction ports on at least one end portion side not used for a suction operation of a small-size object, wherein each of the air shutter devices is constituted by a passage block having an air passage through which air for sucking an object passes, a magnetic member arranged around an air passage opening portion of the passage block, and a shutter member consisting of a magnetic material and movable between a closed position where the air passage opening portion of the passage block including the magnetic member is closed and an open position where the air passage is open, one of the magnetic member and the shutter member being magnetized, and the shutter member moves to the closed position to close the air passage opening portion of the passage block by an air suction force and a magnetic attraction force between the shutter member and the magnetic member when the suction operation of the small-size object is performed.

DESCRIPTION OF THE PREFERRED EMBODIMENTS

Figure 6A:
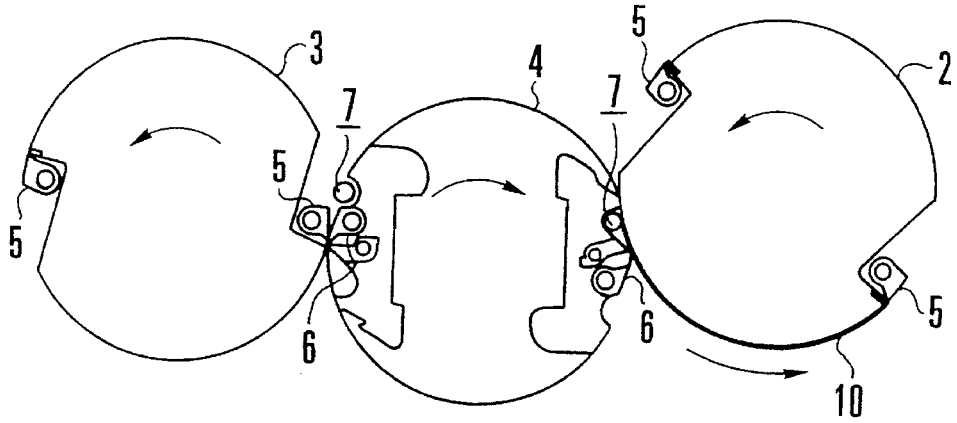
FIGS. 6A to 6C are views showing the cylinder arrangement so as to explain a double side printing operation of a printing press.
Figure 6B:
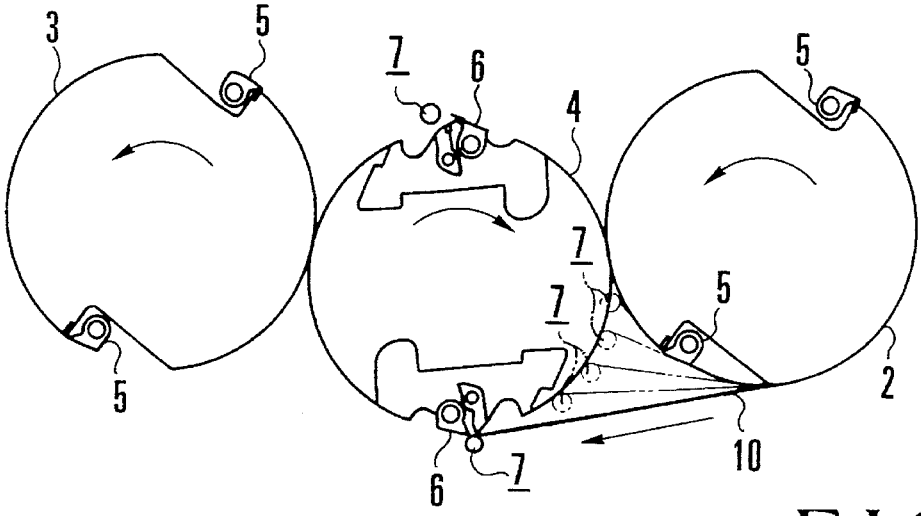
Figure 6C:
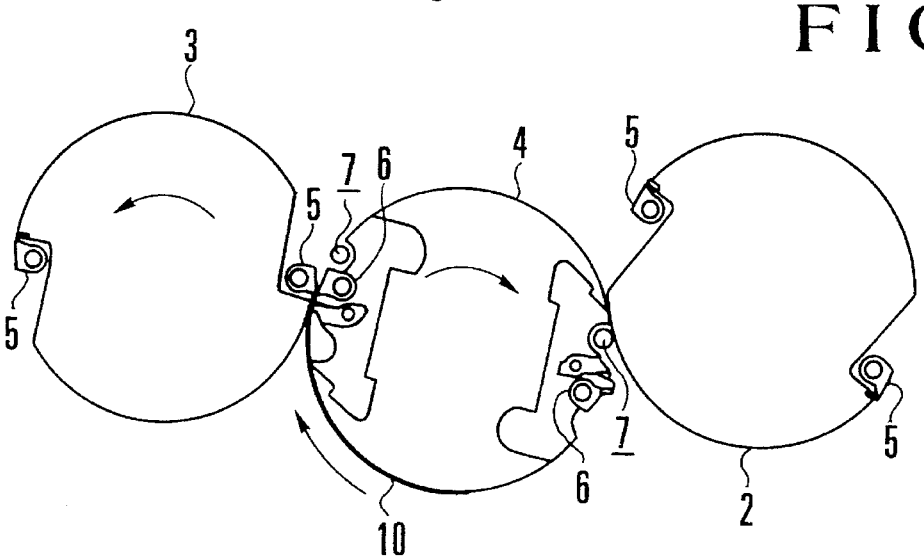

An embodiment of the present invention will be described below with reference to the accompanying drawings. The cylinder arrangement for a double side printing operation of a printing press will be described with reference to FIGS. 6A to 6C. Referring to FIGS. 6A to 6C, reference numeral 2 denotes a first impression cylinder serving as an upstream cylinder with respect to the rotational direction of the cylinder, which is indicated by an arrow, i.e., the paper convey direction; 3, a second impression cylinder serving as a downstream cylinder; and 4, a reversing cylinder serving as a paper convey cylinder having a circumferential surface contacting the impression cylinders 2 and 3, and having the same diameter as that of the impression cylinders 2 and 3.

Figure 2A:
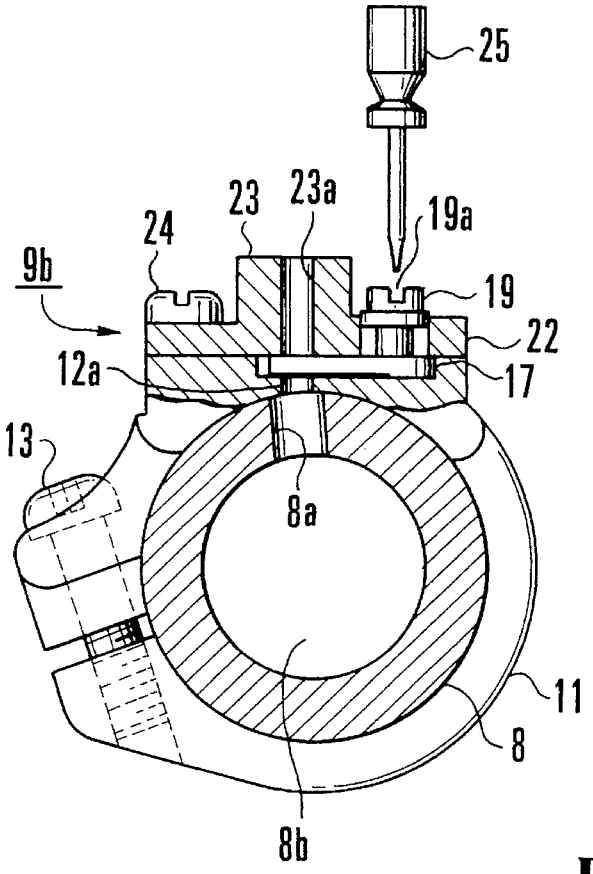
FIG. 2A is a side view of the suction port shown in FIG. 1.
Figure 4:
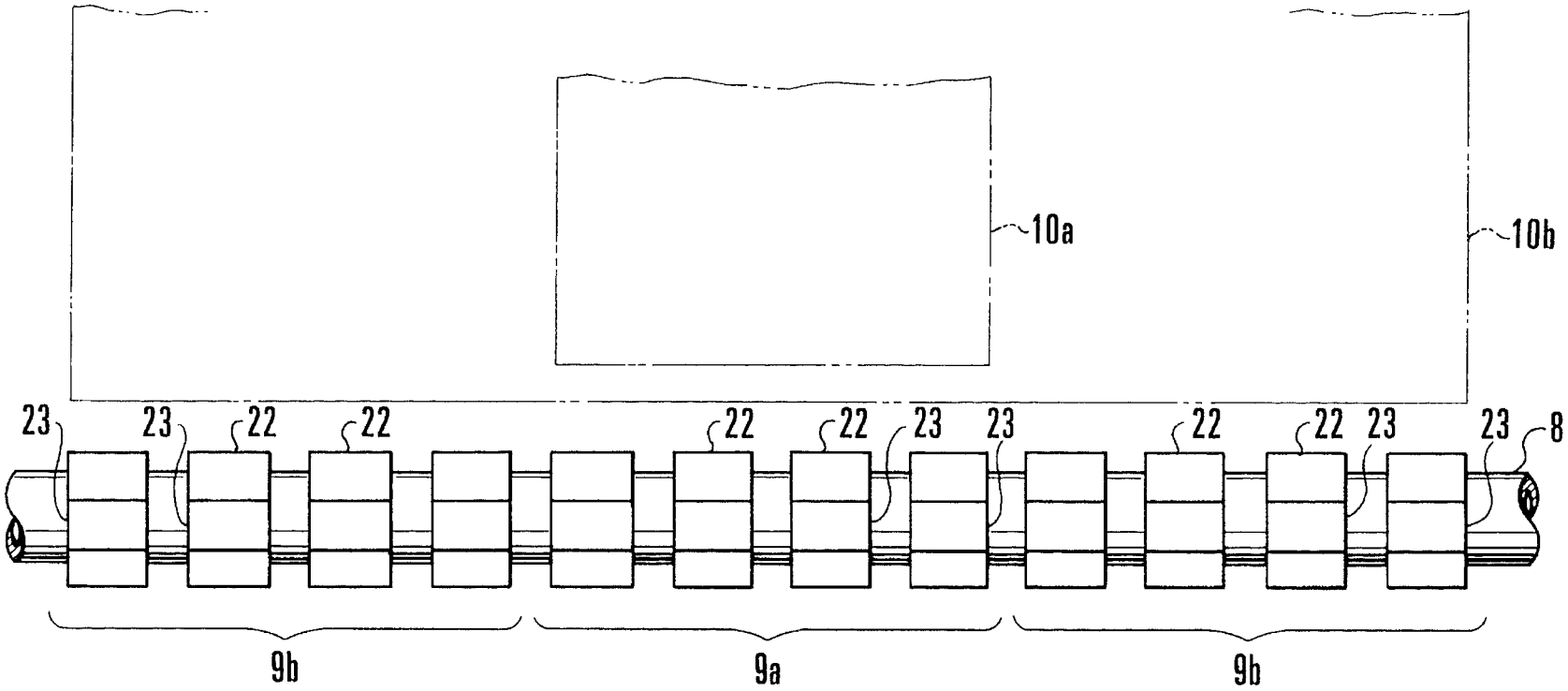
FIG. 4 is a plan view showing the overall arrangement of a suction apparatus having the suction port shown in FIG. 1.

Gripper units 5 are disposed in gaps which equally halve the circumferential surface of each of the impression cylinders 2 and 3. Reversing gripper units 6 are disposed in gaps which equally halve the circumferential surface of the reversing cylinder 4, and shifted from the gripper units 5 in the axial direction. Suction apparatuses 7 are arranged in the axial direction and disposed in the gaps where the reversing gripper units 6 are arranged. The gaps in which the gripper units 5 and the reversing gripper units 6 are disposed extend in the axial direction of the impression cylinders 2 and 3 and the reversing cylinder 4. As shown in FIGS. 2A and 4, in the suction apparatus 7, a plurality of suction ports 9*a* and 9*b* are arranged on a suction lever shaft 8 and fixed by bolts 13 by split-clamping, which suction lever shaft 8 is the same in length as in the shaft of the reversing cylinder 4 and has a tubular hollow portion 8*b*. A plurality of through holes 8*a* serving as air passages extending to the hollow portion 8*b* are formed in the circumferential surface of the suction lever shaft 8 in correspondence with the positions of the suction ports 9*a* and 9*b*. One end side of the suction lever shaft 8 is coupled to an air suction pump (not shown) through a hose. When the pump is operated, air in the hollow portion 8*b* of the suction lever shaft 8 is sucked. The suction ports 9*a* are arranged at positions corresponding to a minimum-size paper sheet 10*a*, i.e., at the central portion of the suction lever shaft 8, and have no shutter device 15 (to be described later). On the other hand, the suction ports 9*b* are arranged at positions corresponding to a maximum-size paper sheet 10*b* except for the area of the minimum-size paper sheet 10*a*, i.e., at the two end portions of the suction lever shaft 8 while sandwiching the suction ports 9*a* at the central portion. The suction ports 9*b* have the shutter devices 15 (to be described later).

Figure 1:
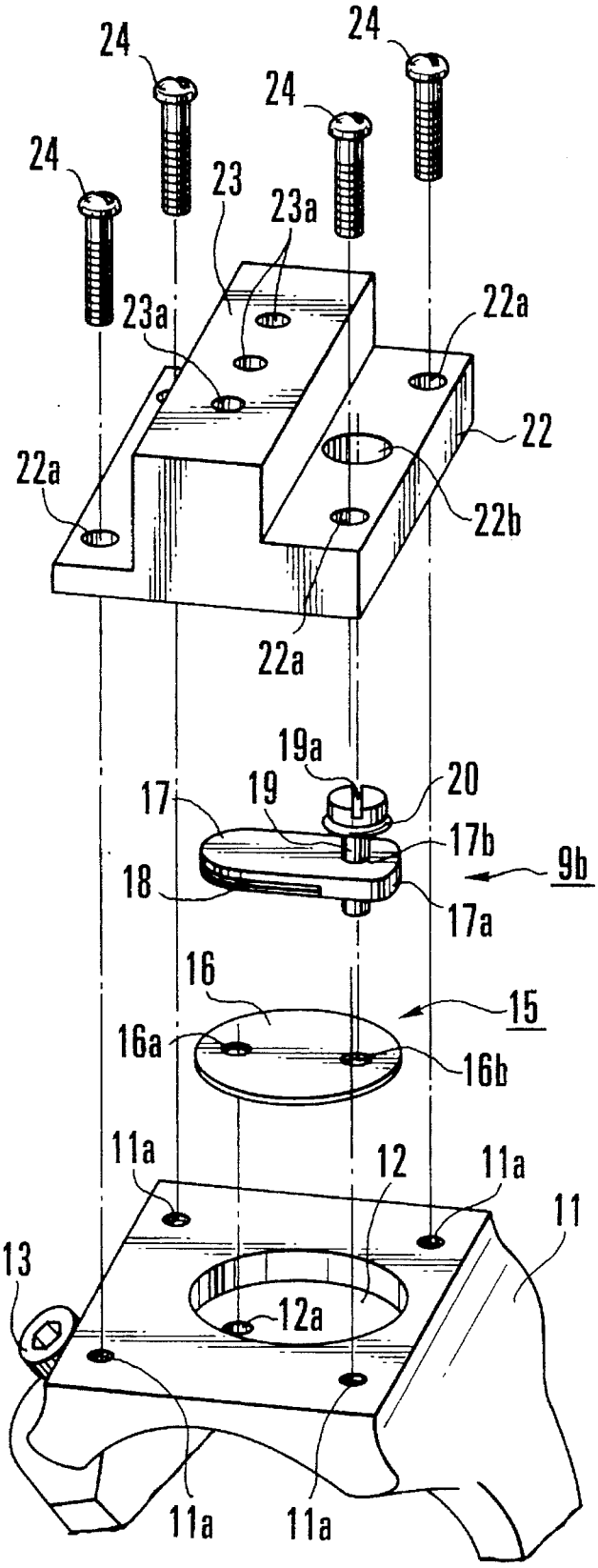
FIG. 1 is an exploded perspective view showing a suction port according to an embodiment of the present invention.

The structure of the suction port 9*b* having the shutter device 15 will be described below in detail. As shown in FIG. 1, the suction port 9*b* is constituted by a holder 11 fixed to the suction lever shaft 8 through the bolt 13 by split-clamping, the shutter device 15 for shielding the air passage, which is the characteristic feature of the present invention, and a suction head 22. Bolt holes 11*a* are threadably formed at the four corners of the upper surface of the holder 11. A recessed portion 12 having a circular shape viewed from the upper side is formed at the central portion of the holder 11. A through hole 12*a* as an air passage is formed in the recessed portion 12. The shutter device is constituted by a flexible magnetized disk-like magnet rubber 16, and a shutter operating member 17 having a substantially rectangular shape viewed from the upper side. The shutter operating member 17 has, on its one end side, a thick-walled proximal portion 17*a* with a through hole 17*b*. The overall length of the shutter operating member 17 is slightly smaller than the diameter of the recessed portion 12. A through hole 16*a* having the same diameter as that of the through hole 12*a* is formed in the magnet rubber 16 at the first eccentric position. A bearing hole 16*b* is formed at the second eccentric position opposing the through hole 16*a* with respect to the center.

A very thin plate-like shutter 18 has almost the same planar shape as that of the shutter operating member 17. The shutter 18 is formed of a steel plate having magnetic properties and a low rigidity. One end of the shutter 18 is fixed to the lower surface of the proximal portion 17*a* of the shutter operating member 17 and integrated with the shutter operating member 17. The free end of the shutter 18 opposes the distal end portion of the shutter operating member 17 at a small internal. An operating pin 19 has a slotted groove 19*a* at its head portion. The distal end of the operating pin 19 pressed into the through hole 17*b* extends through the shutter 18 to fix the shutter operating member 17 and the shutter 18 in the recessed portion 12. The shutter 18 is in contact with the magnet rubber 16 and fixed to the bottom surface of the recessed portion 12. An O-ring 20 is fitted on the operating pin 19 to prevent air leakage from the through hole 17*b*.

A suction head 22 is formed to have a convex section. In correspondence with the bolt holes 11*a* of the holder 11, setting holes 22*a* are formed at the four corners of a pair of flange portions different in thickness. A bearing hole 22*b* having almost the same diameter as that of the O-ring 20 is formed at the center of one flange portion. The upper surface of the projecting portion sandwiched between the pair of flange portions of the suction head 22 constitutes a suction surface 23 for sucking a paper sheet. Three through holes 23*a* serving as air passages are formed in the suction surface 23 while being arranged in a line in correspondence with the recessed portion 12 of the holder 11. Bolts 24 tightly attach the suction head 22 to the holder 11.

The assembly operation of the suction port 9*b* with the above structure will be described. As shown in FIG. 2A, the holder 11 is fixed to the suction lever shaft 8 through the bolt 13 by split-clamping such that the through hole 12*a* coincides with the through hole 8*a* of the suction lever shaft 8. Subsequently, the magnet rubber 16 is fixed to the bottom surface of the recessed portion 12 of the holder 11 with an adhesive such that the through hole 16*a* coincides with the through hole 12*a*. After the distal end of the operating pin 19 is fitted in the bearing hole 16*b* of the fixed magnet rubber 16, the shutter operating member 17 is placed on the magnet rubber 16 and accommodated in the recessed portion 12, thereby setting the shutter device 15. Finally, after the bearing hole 22*b* of the suction head 22 is fitted on the O-ring 20, the bolts 24 are inserted into the setting holes 22*a* and threadably engaged with the bolt holes 11*a*, thereby tightly fixing the suction head 22 to the upper surface of the holder 11.

With this arrangement, the distal end of the operating pin 19 is axially supported in the bearing hole 16*b*, and the O-ring 20 is axially supported in the bearing hole 22*b*. Therefore, the shutter operating member 17 is swingably supported by the bearing holes 16*b* and 22*b*.

On the other hand, the suction port 9*a* has the same arrangement as that of the suction port 9*b* except that the shutter device 15 is not provided. More specifically, the suction port 9*a* is constituted by the holder 11 and the suction head 22, and the through hole 12*a* communicating with the hollow portion 8*b* of the suction lever shaft 8 is always open without being closed.

The operation of the shutter device 15 having the above structure will be described below. When air in the hollow portion 8*b* of the suction lever shaft 8 is sucked in accordance with the operation of the suction pump (not shown), air in the recessed portion 12 of the holder 11 is sucked through the through holes 8*a* and 12*a*. As shown in FIG. 2A, the distal end of a driver 25 is fitted in the slotted groove 19*a* of the operating pin 19 to pivot the operating pin 19 counterclockwise in FIG. 2B. With this operation, the shutter operating member 17 also swings about the operating pin 19 and moves to a position indicated by a chain double-dashed line, where the shutter 18 closes the through hole 16*a*. The longitudinal length of the shutter operating member 17 is slightly smaller than the diameter of the recessed portion 12, and the pivotal center is set at the eccentric position of the recessed portion 12. For this reason, one corner of the distal end of the swinging shutter operating member 17 is brought into contact with the circumferential surface of the recessed portion 12. The swing motion of the shutter 18 fixed to the shutter operating member 17 is also regulated by the stopper function of the circumferential surface of the recessed portion 12, so that the shutter 18 stops on the through hole 16*a*. The shutter 18 closes the through hole 16*a* at this position.

When the operating pin 19 is to be excessively pivoted, the shutter 18 formed of a thin steel plate is prevented from being destroyed because the shutter operating member 17 in contact with the circumferential surface of the recessed portion 12 protects the shutter 18.

Figure 3A:
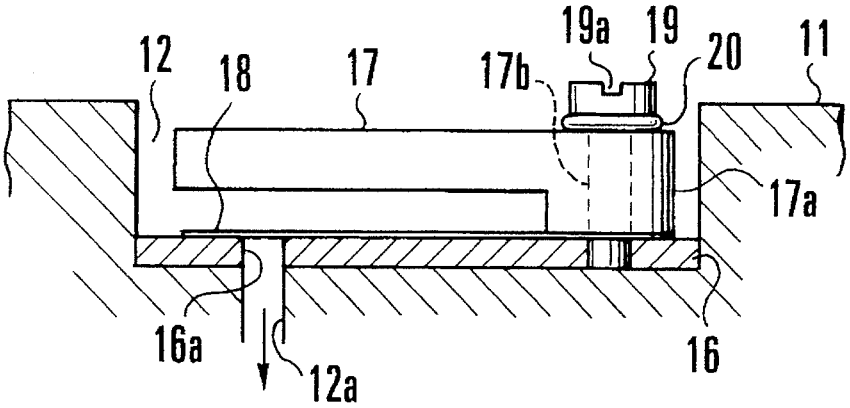
FIGS. 3A to 3C are views showing operating states of the shutter device of the suction port shown in FIG. 1.
Figure 3B:
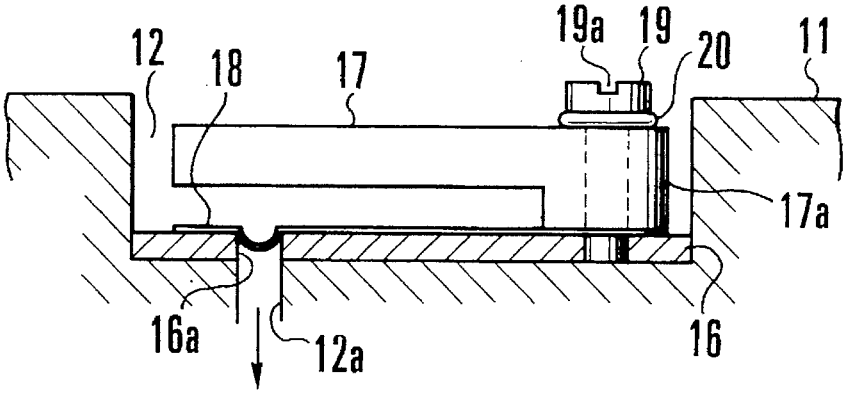

As shown in FIG. 3A, when air suction is performed while the through hole 16*a* is closed with the shutter 18, the shutter 18 is deflected at a portion closing the through hole 16*a* and enters the through hole 16*a*, as shown in FIG. 3B, because the shutter 18 is formed of a material with a low rigidity. As a result, the degree of closing of the through hole 16*a* increases to prevent a gap from being formed between the shutter 18 and the magnet rubber 16. In addition, since the magnet rubber 16 is formed of a flexible material, the magnet rubber 16 deforms into the same shape of the deflected shutter 18. Therefore, the contact area between the shutter 18 and the magnet rubber 16 increases to further increase airtightness.

Figure 3C:
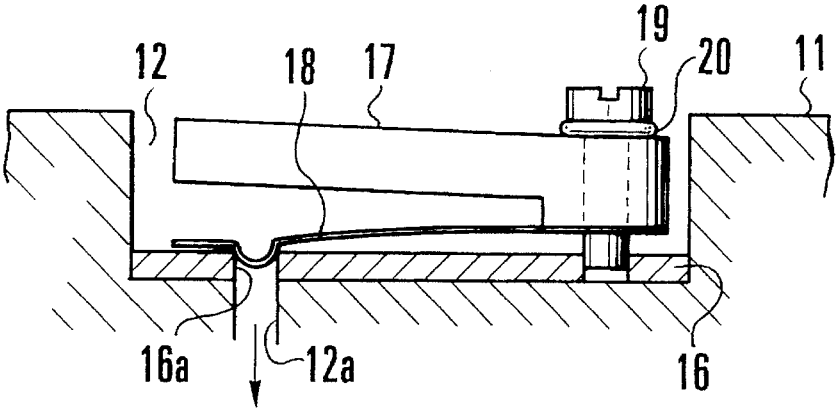

The deflection of the shutter 18 shown in FIGS. 3B and 3C is exaggerated for the descriptive convenience. Experimentally, as the shutter 18 capable of being partially deflected but not destroyed by the air suction force, a steel plate of 0.03 to 0.05 mm in thickness is optimally used. Instead of forming the entire shutter 18 from a very thin plate, only a portion corresponding to the through hole 16*a* may be made thin. Alternatively, a hole may be formed in the shutter 18 at a position corresponding to the through hole 16*a*, and a thin film or rubber not allowing air transmission may be expanded, and the peripheral portion of the through hole 16*a* may be deflected.

Furthermore, since the shutter 18 formed of a steel plate is magnetically sucked by the magnet rubber 16, a gap is prevented from being formed between the shutter 18 and the magnet rubber 16 in cooperation with the air suction force. Therefore, the airtightness between the shutter 18 and the magnet rubber 16 is firmly held.

As shown in FIG. 3C, when the operating pin 19 serving as a support shaft for the shutter operating member 17 is obliquely attached, and the shutter 18 is attached at an angle to the magnet rubber 16, a gap is formed between the shutter 18 and the magnet rubber 16 at the position of the through hole 16*a*. In this case as well, the shutter 18 is deflected in the longitudinal direction by the air suction force and the magnetic force of the magnet rubber 16, and the distal end portion is moved to the through hole 16*a* side and enters the through hole 16*a* due to the suction air to close the through hole 16*a*. As described above, the through hole 16*a* as the air passage can be closed independently of the attached state of the operating pin 19. Therefore, the air passage can always be closed independently of the assembly accuracy of the shutter device 15.

Figure 2B:
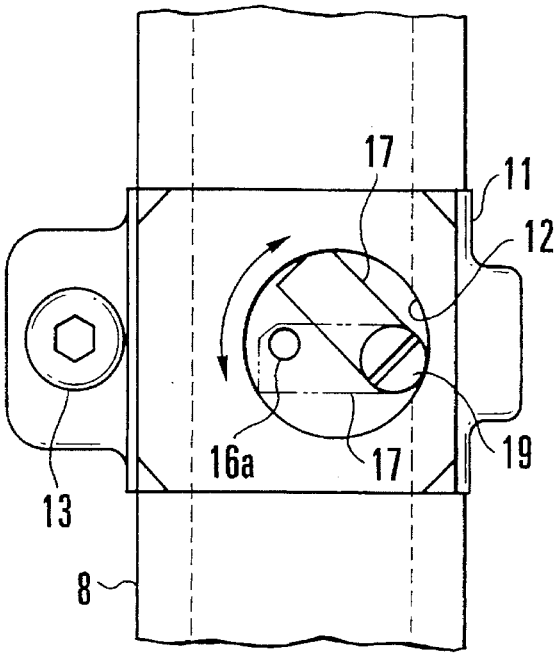
FIG. 2B is a plan view of a shutter device portion of the suction port shown in FIG. 1.

To open the through hole 16*a* as the air passage, the operating pin 19 is pivoted clockwise in FIG. 2B by the driver 25. With this operation, the shutter operating member 17 and the shutter 18 also swing in accordance with the pivotal motion of the operating pin 19 to cancel the closed state of the through hole 16*a* by the shutter 18. At this time, the other corner portion of the distal end of the shutter operating member 17 is brought into contact with the circumferential surface of the recessed portion 12 serving as a stopper, thereby regulating the pivotal motion of the shutter 18. The shutter 18 stops at a position offset from the through hole 16*a*, and the through hole 16*a* is properly opened by the shutter 18. In this case, the magnet rubber 16 is fixed to the entire bottom surface portion of the recessed portion 12 to magnetically hold the shutter 18. Therefore, the shutter operating member 17 is moved to the through hole 16*a* side in accordance with air suction through the through hole 16*a*, thereby preventing the through hole 16*a* from being erroneously closed.

A double side printing operation using this shutter device 15 will be described below. When a double side printing operation of the maximum-size paper sheet 10*b* is to be performed, the air passages of all the suction ports 9*b* each having the shutter device 15 are opened. More specifically, as described above, the operating pin 19 of each suction port 9*b* is pivoted clockwise in FIG. 2B to open the air passage of the through hole 16*a*. In this state, the suction pump (not shown) is operated to suck air in the hollow portion 8*b* of the suction lever shaft 8. With this operation, the suction ports 9*b* perform the suction operation through the through holes 23 of the suction heads 22, which communicate with the open through holes 16*a*.

As shown in FIG. 6A, upon the suction operation of the suction heads 22, the trailing edge of a paper sheet 10 whose leading edge is gripped by the gripper unit 5 of the first impression cylinder 2 is sucked by all the suction ports 9*a* and 9*b* constituting the suction apparatus 7 of the reversing cylinder 4, i.e., the suction surfaces 23 of the suction heads 22 along the paper edge. When the first impression cylinder 2 and the reversing cylinder 4 are further pivoted, the paper sheet 10 whose trailing edge is sucked by the suction apparatus 7 is gradually and smoothly separated from the first impression cylinder 2. Thereafter, the trailing edge of the paper sheet 10 is gripped from the suction apparatus 7 to the reversing gripper unit 6. Simultaneously, the leading edge of the paper sheet 10 is released from the gripper unit 5, thereby completing gripping of the paper sheet 10 to the reversing cylinder 4. The paper sheet 10 completely gripped by the reversing cylinder 4 is wound on the reversing cylinder 4 and conveyed. As shown in FIG. 6C, the trailing edge of the paper sheet 10 gripped by the reversing gripper unit 6 of the reversing cylinder 4 is gripped by the gripper unit 5 of the second impression cylinder 3. In this manner, the surface of the gripped paper sheet 10, which is printed by the first impression cylinder 2, is wound on the circumferential surface of the second impression cylinder 3, and the printing surface is reversed, thereby performing the double side printing operation.

When a double side printing operation of the minimum-size paper sheet 10*a* is to be performed, the air passages of all the suction ports 9*b* each having the shutter device 15 are closed in advance. More specifically, the operating pin 19 of the suction port 9*b* is pivoted counterclockwise in FIG. 2B to close the through hole 16*a*. In this state, air in the hollow portion 8*b* of the suction lever shaft 8 is sucked in accordance with the operation of the suction pump (not shown). With this operation, the suction ports 9*a* located at the central portion of the suction lever shaft 8 perform the suction operation through the through holes 23*a* of the suction heads 22. At this time, the through holes 16*a* of the suction ports 9*b* located at the two end portions of the suction lever shaft 8 are closed to prevent an air leakage. Therefore, the paper suction force of the suction ports 9*a* is not decreased. As a result, a decrease in suction force necessary for the suction operation of the paper sheet can be prevented to satisfactorily convey the paper sheet.

Figure 5:
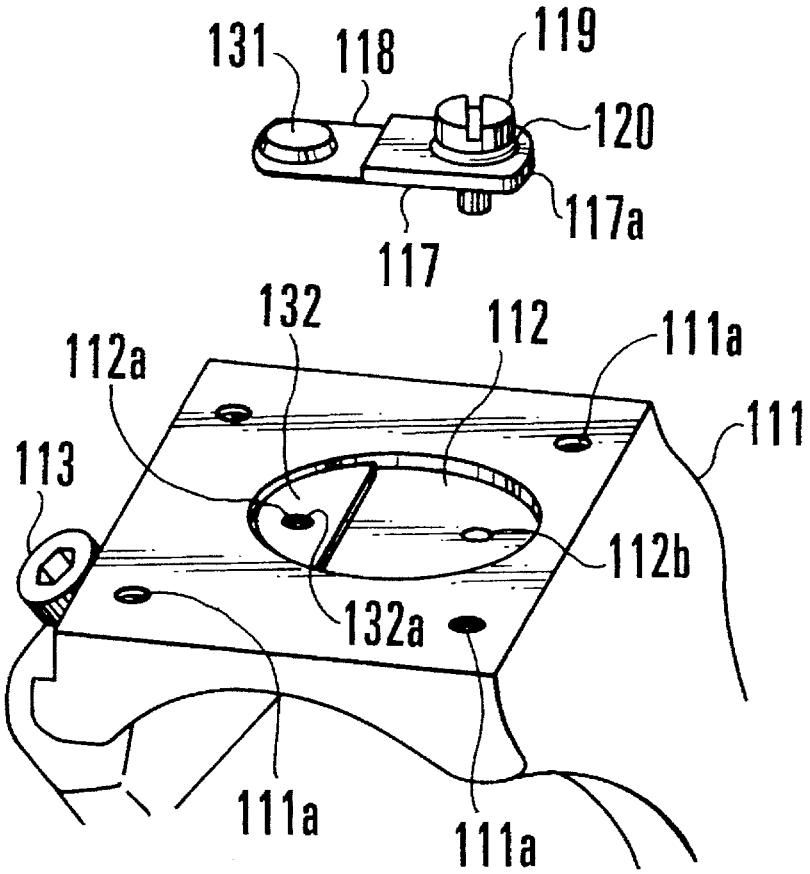
FIG. 5 is an exploded perspective view showing a suction port according to the second embodiment of the present invention.

FIG. 5 shows the main part of an air shutter device according to the second embodiment of the present invention, in which the suction heads are not illustrated. In the second embodiment, the distal end portion of an operating pin 119 of a shutter operating member 117 is removed while leaving only a pressed proximal portion 117*a*. A magnet 131 is fixed on the upper surface of the distal end of a shutter 118 attached to the bottom surface of the proximal portion 117*a*. A semi-circular steel plate 132 having a through hole 132*a* is fixed to the bottom surface portion of a recessed portion 112 while causing the through hole 132*a* to coincide with a through hole 112*a* of the recessed portion 112. The shutter operating member 117 is swingably supported by a bearing hole 22*b* of a suction head 22 and a bearing hole 112*b* of the recessed portion 112 shown in FIG. 1, on which an O-ring 120 is fitted. The shutter operating member 117 is accommodated in the recessed portion 112 through, e.g., a spacer (not shown), such that the lower surface has the same level as that of the steel plate 132. The steel plate 132 may be buried in the recessed portion 112 to form a plane with the bottom surface of the recessed portion 112. Reference numeral 111 denotes a holder; 111*a*, bolt holes; and 113, a bolt.

With this arrangement, the operating pin 119 is pivoted to pivot the shutter operating member 117, thereby positioning the shutter 118 on the through hole 132*a*. At this time, the shutter 118 and the steel plate 132 are brought into tight contact with each other by the magnetic force of the magnet 131 without forming any gap therebetween. For this reason, when air in a hollow portion 8*b* of a suction lever shaft 8 is sucked in accordance with the operation of a suction pump (not shown), the air passage is properly closed without causing air leakage from the through hole 132*a*. Therefore, as in the above first embodiment, a decrease in suction force for a paper sheet at suction ports 9*a* having no shutter device can be prevented.

In this embodiment, the shutter 118 is excited by the magnet 131. However, the shutter 118 itself may be constituted by a magnet rubber.

In each of the above embodiments, the operating pin 19 or 119 which can be pivoted is used to swing the shutter member 17 or 117, thereby opening/closing the through hole 16*a* or 116*a*. The opening/closing method is not limited to this. For example, the shutter member 17 or 17 may be slidably arranged, and various changes in design can also be made.

In addition, the suction ports 9*a* and 9*b* are provided to the reversing cylinder 4 of the printing press. However, the arrangement is not limited to this, and the suction ports 9*a* and 9*b* may also be provided to a paper convey cylinder such as an impression cylinder and the transfer cylinder. The present invention can also be applied to the sucker of a paper sheet feeder or the suction wheel of a delivery apparatus. Furthermore, an example wherein a small-size paper sheet is sucked through the suction ports 9*a* at the central portion has been described above. However, a small-size paper sheet may be sucked through suction ports at one end portion, and the shutter devices 15 may be provided to suction ports at the other end portion.

An example wherein a paper sheet as printed matter is sucked through the suction ports 9*a* and 9*b* has been described above. However, the present invention can also be applied to a case wherein flexible printed matter such as a film or a steel plate is conveyed instead of a paper sheet. The present invention can also be applied to a case wherein a printing plate is sucked and held upon exchange instead of conveyed printed matter.

As has been described above, according to the present invention, suction ports not used for a suction operation are closed. Therefore, a small-size object can be properly sucked.

In addition, air passages are magnetically closed by shutter members at suction ports at the end portions. For this reason, when a small-size object is to be sucked, a gap can be prevented from being formed between the shutter member and the air passage. This results in an increase in degree of closing of the air passage, and therefore air leakage can be prevented.

Furthermore, the shutter member is deflected and enters the air passage due to the air suction force. This results in an increase in degree of closing of the air passage, and therefore air leakage can be prevented.

What is claimed is:

1. A suction apparatus for a printing press, comprising a plurality of suction ports, for sucking and holding an object used for a printing operation, and air shutter devices provided to said suction ports on at least one end portion side not used for a suction operation of a small-size object, wherein each of said air shutter devices is constituted by a passage block having an air passage through which air for sucking an object passes, a magnetic member arranged around an opening of said air passage of said passage block, and a shutter member consisting of a magnetic material and movable between a closed position where said opening of said air passage is closed and an open position where said opening of said air passage is open, one of said magnetic member and said shutter member being magnetized, and said shutter member moves to the closed position to close said opening of the air passage of said passage block by an air suction force and a magnetic attraction force between said shutter member and said magnetic member when the suction operation of said small-size object is performed.

2. An apparatus according to claim 1, wherein said shutter member is constituted by a very thin plate having a low rigidity, which is deflected by the air suction force at the closed position and enters said air passage of said passage block.

3. An apparatus according to claim 2, wherein said magnetic member is constituted by a flexible magnetic rubber fixed to the air passage of said passage block and having a through hole corresponding to said air passage, and a portion of said magnetic rubber around the through hold is pressed by said very thin plate deflected into the same shape as that of the through hole and is brought into tight contact with the through hole.

4. An apparatus according to claim 3, wherein said air passage block has a recessed portion having a bottom surface, said magnetic rubber being constituted by a circular magnetic rubber fixed to said bottom surface of said recessed portion.

5. An apparatus according to claim 2, further comprising a circular recessed portion formed in said passage block such that the air passage is located at a first eccentric position, and an operating member accommodated in the recessed portion, pivoted about a second eccentric position of the recessed portion, and having said very thin plate fixed to a lower surface of said operating member, so that said very thin plate moves between the closed position and the open position upon a pivotal operation of said operating member.

6. An apparatus according to claim 5, wherein said very thin plate has the same planar shape as that of said operating member, said operating member has a length smaller than a diameter of the recessed portion, and when said operating member is pivoted beyond the closed position and the open position, said operating member is brought into contact with a circumferential surface of the recessed portion to protect said very thin plate.

7. An apparatus according to claim 5, wherein said very thin plate projects from said operating member and is fixed, and a magnet for exciting said very thin plate is fixed on an upper surface of Said projecting very thin plate at a position corresponding to the air passage.

8. An apparatus according to claim 1, wherein said object is a paper sheet conveyed for the printing operation, and said suction ports are arranged in a paper convey cylinder in an axial direction to temporarily suck and hold the paper sheet transferred from an upstream cylinder.

9. A paper suction apparatus for a printing press, comprising a plurality of suction ports, arranged in an axial direction and provided to a paper convey cylinder, for temporality sucking and holding a paper sheet transferred from an upstream cylinder, and air shutter devices provided to said suction ports on two end sides not used for a suction operation of a small-size paper sheet, wherein each of said air shutter devices is constituted by a passage block having an air passage through which air for sucking a paper sheet passes, a magnetic member arranged around an opening of said air passage, and a shutter member consisting of a magnetic material and movable between a closed position where said opening of said air passage is closed and an open position where said opening of said air passage is open, one of said magnetic member and said shutter member being magnetized, and said shutter member moves to the closed position to close said opening of said air passage of said passage block by an air suction force and a magnetic attraction force between said shutter member and said magnetic member when the suction operation of said small-size object is performed, thereby preventing air leakage from said suction ports on the two end portion sides which are not used.

10. An apparatus according to claim 9, wherein said shutter member is constituted by a very thin plate having a low rigidity, which is deflected by the air suction force at the closed position and enters said air passage of said passage block.

* * * * *

UNITED STATES PATENT AND TRADEMARK OFFICE

CERTIFICATE OF CORRECTION

PATENT NO. : 5,575,207

DATED : Nov. 19, 1996

INVENTOR(S) : Shimizu

It is certified that error appears in the above-identified patent and that said Letters Patent is hereby corrected as shown below:

In the title page, item [56] FOREIGN PATENT DOCUMENTS, please insert
--DEA 2754370 7/12/77 EPO
DE 4116510 5/21/91 EPO --.

Signed and Sealed this

Twenty-fifth Day of November, 1997

*Attest:*

Bruce Lehman

BRUCE LEHMAN

*Attesting Officer*

*Commissioner of Patents and Trademarks*